United States Patent [19]

Haack et al.

[11] Patent Number: 4,939,061

[45] Date of Patent: Jul. 3, 1990

[54] TONER COMPOSITIONS WITH NEGATIVE CHARGE ENHANCING ADDITIVES

[75] Inventors: John L. Haack; Robert J. Gruber, both of Pittsford, N.Y.

[73] Assignee: Xerox Corporation, Stamford, Conn.

[21] Appl. No.: 356,481

[22] Filed: May 25, 1989

[51] Int. Cl.[5] ..... G03G 9/10; G03G 13/22

[52] U.S. Cl. ..... 430/110; 430/126

[58] Field of Search ..... 430/110, 115

[56] References Cited

U.S. PATENT DOCUMENTS

| | | | |
|---|---|---|---|
| 4,206,064 | 6/1980 | Kiuchi et al. | 430/106 |
| 4,411,974 | 10/1983 | Lu et al. | 430/106 |
| 4,656,112 | 4/1987 | Kawagishi et al. | 430/110 |
| 4,673,631 | 6/1987 | Fukumoto et al. | 430/110 |
| 4,871,649 | 10/1989 | Imataki et al. | 430/270 |

FOREIGN PATENT DOCUMENTS

| | | | |
|---|---|---|---|
| 58-43461 | 3/1983 | Japan | 430/110 |
| 60-196775 | 10/1985 | Japan | 430/110 |
| 61-259268 | 11/1986 | Japan | 430/110 |
| 61-260255 | 11/1986 | Japan | 430/110 |

*Primary Examiner*—Roland E. Martin

*Attorney, Agent, or Firm*—E. O. Palazzo

[57] ABSTRACT

A negative charged toner composition comprised of resin particles, pigment particles, and as a charge enhancing additive dithiolene complexes of the formulas of FIGS. 1,2,3 or 4, wherein X is selenium or sulfur, M is a metal, R is alkyl, Y is a cation, Z represents zinc, and n represents the valence of the cation and anion components.

27 Claims, 1 Drawing Sheet

TONER COMPOSITIONS WITH NEGATIVE CHARGE ENHANCING ADDITIVES

BACKGROUND OF THE INVENTION

Figure 1:
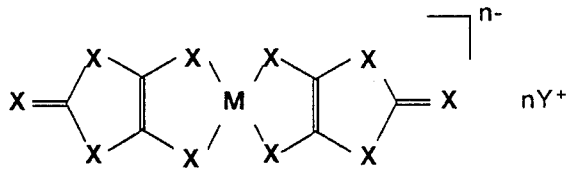

The invention is generally directed to toner compositions, and more specifically, the present invention is directed to developer and toner compositions containing charge enhancing additives, which impart, or assist in imparting a negative charge to the toner resin particles. In one embodiment, there is provided in accordance with the present invention toner compositions comprised of resin particles, pigment particles, and zinc dithiolene complexes, such as bis(tetra-butylammonium), bis(1,3-dithiole-2-thione-4,5-dithiolate)zinc complex, which are available from American Tokyo Kasei, Inc. as negative charge enhancing additives. The aforementioned toner compositions usually contain pigment particles comprised of, for example, carbon black, magentites, cyan, magenta, yellow, blue, green, red, or brown components, and mixtures thereof thereby enabling their selection for the development of black and/or colored images. Additionally, the charge additives illustrated herein are believed to be nontoxic in that, for example, they are capable of generating an acceptable negative Ames test, and further there is provided with the present invention toner compositions with stable electrical properties for extended time periods exceeding, for example, 100,000 imaging cycles in some instances. Moreover, the toner and developer compositions of the present invention can be selected for electrophotographic, especially xerographic, imaging and printing processes.

Developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of electrostatic latent images on negatively charged surfaces is accomplised by applying a developer composition having a positively charged triboelectric realationship with respect to the colloidal silica.

Also, there is disclosed in U.S. Pat. No. 4,338,390, the disclosure of which is totally incorporated herein by reference, developer compositions containing as positive charge enhancing additives organic sulfate and sulfonates. Further, there is disclosed in U.S. Pat. No. 4,298,672 positively charged toner compositions with resin particles and pigments particles, and as charge enhancing additives alkyl pyridinium compounds. Additionally, other documents disclosing positively charged toner compositions with charge control additives include U.S. Pat. Nos. 3,944,493; 4,007,293; 4,079,014 and 4,394,430.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. There is disclosed in the '064 patent toner compositions with chromium, cobalt, and nickel complexes of salicylic acid as negative charge enhancing additives.

As a result of a patentability search, there were located U.S. Pat. Nos. 4,656,112 and 4,673,631. In the '112 patent, there are described toners for developing electrostatic latent images wherein there is selected as a charge control agent a zinc complex compound of aromatic hydroxy carboxylic acid with or without a substituent, reference the Abstract of the Disclosure. These toners may be negatively charged, reference column 2, lines 5 to 10. The formula of the zinc complex is represented in column 2, beginning at line 35. The '631 patent describes a triboelectrically chargeable toner composition, which contains a metal complex of an amino acid compound having an amino or amino substituted amino group, and a carboxylic acid, reference the Abstract of the Disclosure. Also, note the teachings in column 5, lines 5 through 18. Further, it is indicated in column 5, lines 40 to 42, of the '631 patent that the aforementioned metal complex can be a good positive charge controller.

There is illustrated in U.S. Pat. No. 4,404,271, the disclosure of which is totally incorporated herein by reference, a complex system for developing electrostatic images with a toner which contains a metal complex represented by the formula in column 2, lines 20 to 31; and wherein ME can be chromium, cobalt or iron. Additionally, other U.S. patents dislcosing various metal containing azo dyestuff structures wherein the metal is chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Other prior art includes Japanese Publication No. 54-145542 which illustrates a negatively chargeable toner consisting of a resin, a colorant, and the charge control agent pyridoxine aliphatic acid ester; East German Patent Publication No. 218697 relating to liquid developers with charge control additives with structural units of formulas (I), (II) and (III), which contain olefinically polymerizable bonds; U.S. Pat. No. 3,850,642 relating to multilayer sensitive elements with ionizable salts, acids, esters, and surfactants as charge control agents; 2,970,802 illustrating a composition for the control of hypercholestermia, which composition consists of a nontoxic gelatin containing aluminum nicotinate; 3,072,659 which discloses a method of preparing aluminum salts of nicotinic acid; Japanese Publication No. 61/239443, which discloses bisphenyl dithiol transition metal complexes for optional recording; the *Journal of Organic Chemistry,* 1987, 52, 3285; and *Molecular Crystal Liquid Crystals,* 1982, 86, 159.

Furthermore, there is disclosed in copending application U.S. Ser. No. 822,186, the disclosure of which is totally incorporated herein by reference, toner compositions containing as negative charge enhancing additives iron complexes, including the iron complex of azo dyes prepared from coupling diazotized substituted amino phenols with substituted naphthols.

Although many charge enhancing additives are known, there continues to be a need for new additives, especially those that impart negative charges to toner resin particles. Additionally, there is a need for negative charge enhancing additives which are useful for incorporation into black, or colored toner compositions.

There is also a need for toner compositions with negative charge enhancing additives that possess acceptable triboelectric charging characteristics, and suitable admixing properties. Moreover, there continues to be a need for humidity insensitive negatively charged toner and developer compositions. Further, there is a need for charge enhancing additives which can be easily and permanently dispersed into toner resin particles. There also is a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally, the toner compositions of the present invention are useful in imaging apparatuses having incorporated therein layered photoresponsive imaging members, such as the members illustrated in U.S. Pat. No. 4,265,990, the disclosure of which is totally incorporated herein by reference. Furthermore, there is a need for negatively charged toner compositions with desirable and rapid toner admix charging characteristics of, for example, from about less than 2 minutes.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

In yet another object of the present invention there are provided negatively charged toner compositions containing as charge enhancing additives zinc dithiolene complexes.

Also, in another object of the present invention there are provided developer compositions with negatively charged toner particles, carrier particles, and zinc dithiolene charge enhancing additives.

In yet a further object of the present invention there are provided humidity insensitive negatively charged toner compositions with desirable admix properties, less than 2 minutes for example, and acceptable triboelectric charging characteristics.

Additionally, in a further object of the present invention there are provided negatively charged magnetic toner compositions, and negatively charged colored toner compositions containing therein zinc dithiolene charge enhancing additives.

Furthermore, in yet another object of the present invention there are provided toner compositions with negative charge enhancing additives, which compositions are useful in a variety of electrostatic imaging and printing processes, including color xerography.

Figure 2:
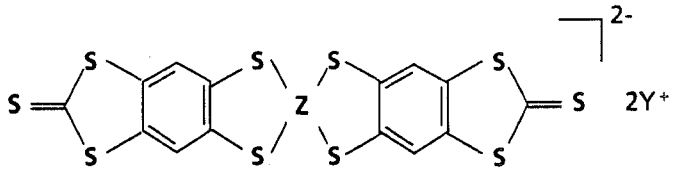
Figure 3:
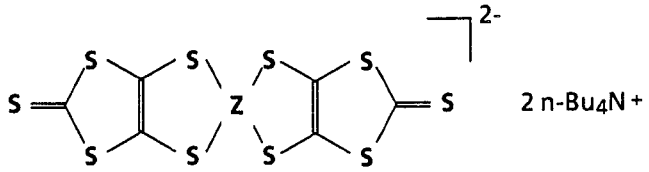
Figure 4:
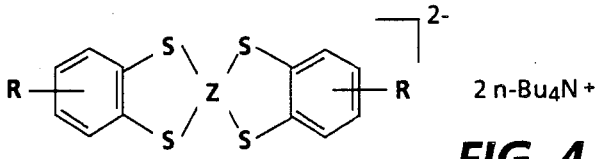

These and other objects of the present invention are accomplished by providing toner compositions comprises of resin particles, pigment particles, and as charge enhancing additives zinc ditholene complexes of the formulas as illustrated in FIGS. 1 to 4, wherein R is an alkyl or substituted alkyl group with alkyl being, for example, of from 1 to about 25 carbon atoms, and preferably from 1 to about 18 carbon atoms, including methyl, ethyl, propyl, butyl, heptyl, hextyl, octyl, nonyl and the like; X is sulfur or selenium; M is a metal such as zinc, nickel, lead, paladium and the like; Y is a cation such as an alkali metal including sodium or lithium; alkyl ammonium, particularly $NBu_4$ (tetrabutylammonium) tetraethyl ammonium, and the like; Z represents zinc; and n represents the valence of the cation and anion components. Substituted substituents include alkyl, halogen, nitro, and the like. The aforementioned charge enhancing additives are available from American Tokyo Kasei, Inc.

Illustrative examples of suitable toner resins selected for the toner and developer compositions of the present invention are polyamides, polyolefins, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; vinyl propionate, vinyl benzoate, and vinyl butyrate; vinyl esters like esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acylonitrile, methacrylonitrile, acrylamide; vinyl ethers, such as vinyl methyl ether, vinyl isobutyl ether, vinyl ethyl ether, and the like; vinyl ketones such as vinyl methyl ketone, vinyl hexyl ketone, and methyl isopropenyl ketone; and the like; styrene butadiene copolymers; Pliolites; suspension polymerized styrene butadiene resins, reference U.S. Pat. No. 4,558,108, the disclosure of which is totally incorporated herein by reference; and mixtures thereof.

As one preferred toner resin, there is elected the esterification products of a dicarboxylic acid and a diol comprising a diphenol. These resins are illustrated in U.S. Pat. No. 3,590,000, the disclosure of which is totally incorporated herein by reference. Other preferred toner resins include styrene/methacrylate copolymers, and styrene/butadiene copolymers; polyester resins obtained from the reaction of bisphenol A and propylene oxide; followed by the reaction of the resulting product with fumaric acid; and branched polyester resins resulting from the reaction of dimethylterephthalate, 1,3-butanediol, 1,2-propanediol, and pentaerythritol; styrene acrylates; and mixtures thereof. Also, waxes with a molecular weight of from about 1,000 to about 6,000 such as polyethylene, polypropylene, and paraffin can be incorporated into or added to the toner compositions as fuser roll release agents.

The resin particles are present in a sufficient, for example preferably from about 70 to about 90 weight percent, but effective amount, thus when 5 precent by weight of the charge enhancing additive is present, and 10 percent by weight of pigment or colorant such as carbon black is selected, about 85 percent by weight of resin is selected. Generally, from about 0.1 weight precent to about 10 weight percent, and preferably from about 0.1 weight percent to about 5 weight precent of the charge enhancing additive, preferably as a surface component, is selected for mixing with the toner particles; however, the charge enhancing additive of the present invention can be used in various other amounts providing the objectives of the present invention are accomplished. Also, the charge enhancing additives of the present invention can be blended into the toner composition or coated on the pigment particles. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, nigrosine dye, aniline blue, magnetite, and mixtures thereof. The pigment, which is preferably carbon black, should be present in a sufficient amount to render the toner composition highly colored. Generally, the pigment particles are present in amounts of from about 2 percent by weight to about 20, and preferably from about 3 to about 10 percent by weight, based on the total weight of the toner composition; however, lesser or greater amounts of pigment particles can be selected providing the objectives of the present invention are achieved.

When the pigment particles are comprised of magnetites, thereby enabling single component toners in some instances, which magnetites are a mixture of iron oxides ($FeO.Fe_2O_3$) including those commercially available as Mapico Black, they are present in the toner composition in an amount of from about 10 percent by weight to about 70 percent by weight, and preferably in an amount of from about 10 percent by weight to about 50 percent by weight.

There can also be blended into the toner compositions of the present invention external additive particles including flow aid additives, which additives are usually present on the surface thereof. Examples of additives include colloidal silicas such as Aerosil, and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 precent by weight. Several of the aforementioned additives are illustrated in U.S. Pat. Nos. 3,590,000 and 3,800,588, the disclosures of which are totally incorporated herein by reference. In one embodiment of the present invention, the zinc complex charge additives may be solvent treated onto the surface of colloidal silicas such as Aerosil. More specifically, the aforementioned treated colloidal silicas can be roll milled onto the surface of toners, especially colored toners with cyan, magenta, yellow or other pigments.

Also encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles as well as mixtures thereof. More specifically, with regard to the production of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

Examples of preferred zinc dithiolene complexes include bis(tetra-n-butylammonium) bis-(1,3-dithiole-2-thione-4,5-dithiolate) zinc complex, bis(alkylammonium) bis(-2-thio-ox-or seleno-1,3-dithiol-4,5-ditholate) metal complex; bis(tetra-n-butylammonium) bis(-benzene 1,3-dithide-2-thione-5,6-dithiolate) zinc complex; bis(tetra-n-butyl ammonium) bis-(benzene-2-alkyl-4,5-dithiolate) zinc complex; and the like.

For the formulation of developer compositions, there are mixed with the toner particles carrier components, particularly those that are capable of triboelectrically assuming an opposite polarity to that of the toner composition. Accordingly, the carrier particles of the present invention are selected to be of a positive polarity enabling the toner particles which are negatively charged to adhere to and surround the carrier particles. Illustrative examples of carrier particles, include iron powder, steel, nickel, iron ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. Generally the coating is present in an amount of from about 0.1 to 10, and preferably 1 to about 3 weight percent coating weight. The carrier particles may also include in the coating conductive substances such as carbon black in an amount of from about 5 to about 30 percent by weight. Also, carrier particles with coatings not in close proximity in the triboelectric series can be selected including Kynar and polymethylmethacrylate, reference copending applications U.S. Ser. No. 136,792, and U.S. Ser. No. 136,791, the disclosures of which are totally incorporated herein by reference.

Futhermore, the diameter of the carrier particles is generally from about 50 microns to about 1,000 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods including melt blending the toner resin particles, pigment particles or colorants, and the charge enhancing additive of the present invention; followed by mechanical attrition. Other methods include those well known in the art such as spray drying, melt dispersion, extrusion processing, dispersion polymerization, and suspension polymerization. The charge additive may be incorporated into the toner, or can be added as a surface component present in some instances on colloidal silicons or other similar materials subsequent to preparation of the toner. The toner can then be subjected to attraction, and classification enabling toner particles with, for example, an average diameter of from 5 to about 25 microns.

The toner and developer compositions of the present invention may be selected for use in electrostatographic imaging apparatuses containg therein conventional photoreceptors. This usually occurs with inorganic photoreceptors, illustrative examples of which includes selenium, selenium alloys, such as selenium tellurium, selenium aresenic, halogen doped selenium substances, and halogen doped selenium alloys. Also, the toner and developer compositions of the present invention can be used with layered photoreceptors for discharge area development that are capable of being charged negatively, such as those described in U.S. Pat. No. 4,265,990, the disclosure of which is totally incorporated herein by reference. For the latter members, the discharged areas are developed with the toner compositions of the present invention. Other similar photoreceptors can be selected providing the objectives of the present invention are achievable.

Moreover, as indicated herein the charge enhancing additives of the present invention can be admixed with surface additives such as colloidal silica particles prior to the preparation of the toner composition. Accordingly, for example, the charge enhancing additives of the present invention may be absorbed on colloidal silica particles in amounts of from about 0.1 to about 3 weight percent and preferably from about 1 to about 3 weight percent.

The following examples are being supplied to further define various species of the present invention, it being noted that these examples are intended to illustrate and not limit the scope of the present invention. Parts and percentages are by weight unless otherwise indicated.

EXAMPLE I

Magenta Developer:

A slurry of 5.0 grams of Aerosil R972 (Degussa) in about 250 milliliters of an organic solvent such as acetone, methylethyl ketone, or chloroform were mixed thoroughly in an explosion-proof blender. The charge control candidate compound, such as the zinc complex as illustrated in FIGS. 1 to 4, and more specifically bis(tetra-n-butyl ammonium) bis-(1,3-dithiole-2-thione-4,5-ditholate) zinc complex (0.5 gram, 10 percent by weight) of known solubility and 150 milliliters of additional solvent were added to the slurry and mixed for about 10 minutes. The resultant mixture was then transferred to a round bottom flask and evaporated to dryness (40° C.) on a rotoevaporator. The residual solid was dried in a vacuum oven for several hours (4 to 16 hours) then placed in a blender equipped with a four blade agitator and "fluffed" to a powdery consistency. There resulted the charge control additive finely dispersed on the surface of the Aerosil R972 as deteremined by transmission election microscopy (TEM).

A magenta developer composition was prepared as follows: 90 parts by weight of a styrene butadiene resin (91/9), and 10 parts of a mixture of 5 parts Hostaperm Pink, available from American Hoechst, and 5 parts of styrene-n-butylmethacrylate were melt blended at approximately 80° to 120° C. in an extruder, followed by micronization and air classification to yield toner particles of an average particle diameter size of 9 microns in volume average diameter and 7 microns in number average diameter. The toner particles were then admixed with the Aerosil treated charge control agents bis(tetra-n-butyl ammonium) bis-(1,3-dithiole-2-thione-4,5-ditholate) zinc complex as prepared above.

Subsequently, carrier particles were prepared by powder coating a Toniolo core, available from Toniolo Company, with a particle diameter range of from 80 to 150 microns with 0.7 parts by weight of a coating blend of 40 parts Kynar and 60 parts PMMA (polymethyl methacrylate) at 375° to 400° C. The magenta developer was then prepared by blending 97 parts by weight of the aforementioned coated carrier particles with 3 parts by weight of the above prepared toner in a lab blender for 10 minutes resulting in a developer exhibiting the results shown in Table I.

EXAMPLE II

Cyan Developer:

A cyan developer composition was prepared as follows: 45 parts by weight of a styrene butandiene resin (91/9), 45 parts by weight of sytrene-n-butylmethacrylate resin and 7.5 parts by weight of Sudan Blue OS from BASF were melt blended at approximately 80° to 120° C. in an extruder, followed by micronization and air classification to yield toner particles of a size of 9 microns in volume average diameter and 7 microns in number average diameter. The toner particles were then treated with the above prepared Aerosil treated charge control agent by repeating the procedure of Example I.

Subsequently, carrier particles were prepared by powder coating a Toniolo core, available from Toniolo Company, with a particle diameter range of from 80 to 150 microns with 0.7 parts by weight of a coating blend of 40 parts Kynar and 60 parts PMMA (polymethyl methacrylate) at 375° to 400° C. The magenta developer was then prepared by blending 97 parts by weight of the resulting coated carrier particles with 3 parts by weight of the above prepared toner in a lab blender for 10 minutes resulting in a developer exhibiting the results shown in Table I.

EXAMPLE III

Black Developer (Normagnetic

A black developer composition was prepared as follows: 94 parts by weight of a styrene butadiene resin (91/9), and 6 parts of Regal 300® carbon black available from Cabot Corporation were melt blended at approximately 80° to 120° C. in an extruder, followed by micronization and air classification to yield toner particles of a size of 9 microns in volume average diameter and 7 microns in number average diameter. The toner particles were then mixed with the above prepared Aerosil treated charge control agent by repeating the procedure of Example I.

Subsequently, carrier particles were prepared by powder coating a Toniolo core, available from Toniolo Company, with a particle diameter range of from 80 to 150 microns with 0.7 parts by weight of a blend of 40 parts Kynar and 60 parts PMMA at 375° to 400° C. A black developer was then prepared by blending 97 parts by weight of the coated carrier particles with 3 parts by weight of the toner in a lab blender for 10 minutes resulting in a developer exhibiting the results shown in Table I.

EXAMPLE IV

Black Magnetic Developer:

A black magnetic developer composition was prepared as follows: 79 parts by weight of a styrene butadiene resin, 5 parts of Regal 330® carbon black from Cabot Corporation and 16 percent magnetic oxide (Mapico black) from Columbia Chemical Company were melt blended at approximately 80° to 120° C. in an extruder, followed by micronization and air classification to yield toner particles of a size of 9 microns in volume average diameter and 7 microns in number average diameter. The toner particles were then mixed with the above prepared Aerosil treated charge control agent by repeating the procedure of Example I.

Subsequently, carrier particles were prepared by powder coating a Toniolo core with a particle diameter range of from 80 to 150 microns, available from Toniolo Company, with 0.7 parts by weight of a blend of 40 parts Kynar and 60 parts PMMA at 375° to 400° C. The magenta developer was then prepared by blending 97 parts by weight of the coated carrier particles with 3 parts by weight of the toner in a lab blender for 10 minutes resulting in a developer exhibiting the results shown in Table I.

TABLE I

| | CHARGING RESULTS | | |
|---|---|---|---|
| Developer | Surface Additive | Q/D FC/Micron | Admix Minutes |
| Magenta (control)* | 0.50% Aerosil | −0.70 | 5.00 |
| Magenta | 0.50% | −0.40 | 0.25 |
| Cyan (control)* | 0.50% Aerosil | −0.88 | 5.00 |
| Cyan | 0.50% | −0.35 | 0.25 |
| Black | 0.50% Aerosil | −0.50 | 5.00 |
| Nonmagnetic (control)* | 0.25% Aerosil | −0.53 | less than 5.00 |
| Black | 0.50% | −0.53 | 0.50 |
| Nonmagnetic | 0.25% | −0.70 | 1.00 |
| Black Magnetic (control)* | 0.50% Aerosil | −0.63 | less than 5.00 |
| Black Magnetic | 0.50% | −0.40 | 0.50 |

*No charge control additive

With further respect to the present invention, the charge present on the toner is dependent on a number of factors including the carrier selected; generally, however, a charge of from about a negative 10 to a negative 40, and preferably a negative 10 to a negative 30 coulombs per gram are present on the toner. This charge is expressed by Q/D FC/Micron in Table I. One of the primary advantages of the toner and developer of the present invention resides in the rapid admix characteristics, reference Table I for example.

Other modifications of the present invention will occur to those skilled in the art based upon a reading of the disclosure of the present application and these modifications are intended to be included within the scope of the present invention.

What is claimed is:

1. A negatively charged toner composition comprised of resin particles, pigment particles, and as a charge enhancing additive dithiolene complexes of the formulas of FIGS. 1, 2, 3 or 4, wherein X is selenium or sulfur, M is a metal, R is alkyl, Y is a cation, Z represents zinc, and n represents the valence of the cation and anion components.

2. A toner composition in accordance with claim 1 wherein the charge enhancing additive is bis(tetra-n-butylammonium) bis-(1,3-dithiole-2-thione-4,5-dithiolate) zinc complex.

3. A toner composition in accordance with claim 1 wherein the charge enhancing additive is added to colloidal silica particles prior to formulating the toner.

4. A toner composition in accordance withe claim 1 wherein the charge enhancing additive is of the formula of FIGS. 2, 3 or 4, wherein R is alkyl or substituted alkyl, and Z is zinc.

5. A toner composition in accordance with claim 1 wherein the charge enhancing additive is present in an amount of from about 0.1 to about 10 percent by weight.

6. A toner composition in accordance with claim 1 wherein the resin particles are comprised of styrene polymers or mixtures thereof.

7. A toner composition in accordance with claim 1 wherein the resin particles are comprised of styrene methacrylates, styrene acrylates, styrene butadienes, or mixtures thereof.

8. A toner composition in accordance with claim 1 wherein M is zinc, nickel, lead or pallidium.

9. A toner composition in accordance with claim 1 wherein the resin particles are comprised of first resin particles and second resin particles.

10. A toner composition in accordance with claim 1 containing a wax component with a weight average molecular weight of from about 1,000 to about 6,000.

11. A toner composition in accordance with claim 10 wherein the waxy components is selected from the group consisting of polyethylene and polypropylene.

12. A toner composition in accordance with claim 1 containing as external additives metal salts of a fatty acid, colloidal silicas, or mixtures thereof.

13. A toner composition in accordance with claim 12 wherein the metal salt is zinc stearate.

14. A toner composition in accordance with claim 12 wherein the colloidal silica is Aerosil.

15. A toner composition in accordance with claim 1 wherein the pigment particles are carbon black, magnetites, or mixtures thereof, cyan, magenta, yellow, red, blue, green, brown, and mixtures thereof.

16. A developer composition comprised of the toner composition of claim 1 and carrier particles.

17. A developer composition in accordance with claim 16 wherein the carrier particles are comprised of ferrites or iron powder.

18. A developer composition in accordance with claim 16 wherein the carrier particles are comprised of a core with a coating thereover.

19. A developer composition in accordance with claim 18 wherein the coating is comprised of a methyl terpolymer, a polymethyl methacrylate, or a mixture of coatings not in close proximity in the triboelectric series.

20. A method of imaging which comprises formulating an electrostatic latent image on a positively or negatively charged photoreceptor, affecting development thereof with the toner composition of claim 1, and thereafter transferring the developed image to a suitable substrate.

21. A method of imaging in accordance with claim 20 wherein the transferred image is permanently fixed to the substrate.

22. A method of imaging in accordance with claim 20 wherein the pigment particles for the toner composition are selected from the group consisting of black magnetite, cyan, magenta, yellow, blue, green, red, brown, and mixtures thereof.

23. A toner composition in accordance with claim 1 with an admix time of less than about 1 minute.

24. A toner composition in accordance with claim 1 with a negative triboelectric charge of from about 15 to about 40 microcoulombs per gram.

25. A toner composition in accordance with claim 1 wherein the charge enhancing additive is bis(tetra-n-butylammonium) bis-(1,3-dithiole-2-thione-4,5-dithiolate) zinc complex; bis(alkylammonium) bis(2-thio-ox-or seleno-1,3-dithiol-4,5-ditholate) metal complex; bis(tetra-n-butylammonium) bis(benzene 1,3-dithide-2-thione-5,6-dithiolate) zinc complex; bis(tetra-n-butyl ammonium) bis-(benzene 2-alkyl-4,5-dithiolate) zinc complex; and the like.

26. A toner composition in accordance with claim 1 wherein Y is an alkali metal or an alkyl ammonium.

27. A toner composition in accordance with claim 1 wherein the charge enhancing additive is present on the surface of the toner and wherein said additive is sorbed on colloidal silica particles..

* * * * *